US011293612B2

(12) United States Patent
Hechenberger et al.

(10) Patent No.: US 11,293,612 B2
(45) Date of Patent: Apr. 5, 2022

(54) LIGHT UNIT FOR A MOTOR VEHICLE HEADLAMP

(71) Applicant: ZKW Group GmbH, Wieselburg (AT)

(72) Inventors: Josef Hechenberger, Mondsee (AT); Bernhard Mandl, Ober-Grafendorf (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 17/286,592

(22) PCT Filed: Sep. 26, 2019

(86) PCT No.: PCT/EP2019/076020

§ 371 (c)(1),
(2) Date: Apr. 19, 2021

(87) PCT Pub. No.: WO2020/083601

PCT Pub. Date: Apr. 30, 2020

(65) Prior Publication Data

US 2021/0388960 A1 Dec. 16, 2021

(30) Foreign Application Priority Data

Oct. 25, 2018 (EP) ..... 18202516

(51) Int. Cl.
*F21S 41/147* (2018.01)
*F21S 41/26* (2018.01)
(Continued)

(52) U.S. Cl.
CPC ..... *F21S 41/147* (2018.01); *F21S 41/26* (2018.01); *F21S 41/285* (2018.01); *F21S 41/43* (2018.01);
(Continued)

(58) Field of Classification Search
CPC ..... F21S 41/147; F21S 41/26; F21S 41/663; F21S 41/43; F21S 41/285
See application file for complete search history.

(56) References Cited

U.S. PATENT DOCUMENTS

| | | | |
|---|---|---|---|
| 2010/0226142 | A1 | 9/2010 | Brendle et al. |
| 2014/0016343 | A1 | 1/2014 | Brendle |
| 2017/0276311 | A1 | 9/2017 | Hiki |

FOREIGN PATENT DOCUMENTS

| | | | |
|---|---|---|---|
| DE | 102010046021 | A1 | 9/2010 |
| FR | 2962786 | A1 | 11/2014 |
| JP | 2014120342 | A | 6/2014 |

OTHER PUBLICATIONS

International Search Report for Application No. PCT/EP2019/076020, dated Oct. 29, 2019. (2 pages).

*Primary Examiner* — Matthew J. Peerce
(74) *Attorney, Agent, or Firm* — Eversheds Sutherland (US) LLP

(57) ABSTRACT

The invention relates to a lamp unit (100) for a motor-vehicle lighting device, comprising: a dipped-beam module (101), a main-beam module (102), an imaging optical element (103, 503) connected downstream of the dipped-beam module (101) and the main-beam module (102), having an optical axis (104, 204, 404, 504) and a focal surface (116) orientated normal to the optical axis (104, 204, 404, 504), and a diaphragm (105, 405), which has a diaphragm edge (106, 206, 306) and extends essentially up to the focal surface (116) of the imaging optical element (103, 503) for generating the horizontal cut-off line in a light image generated by the lamp unit (100), wherein the diaphragm (105, 405) has an opaque diaphragm region (107, 407) and has a transparent diaphragm region (108, 408) with a geometric structure (109, 409) made from a transparent material at the diaphragm edge (106, 206, 306) in the region of the focal
(Continued)

Figure 1:
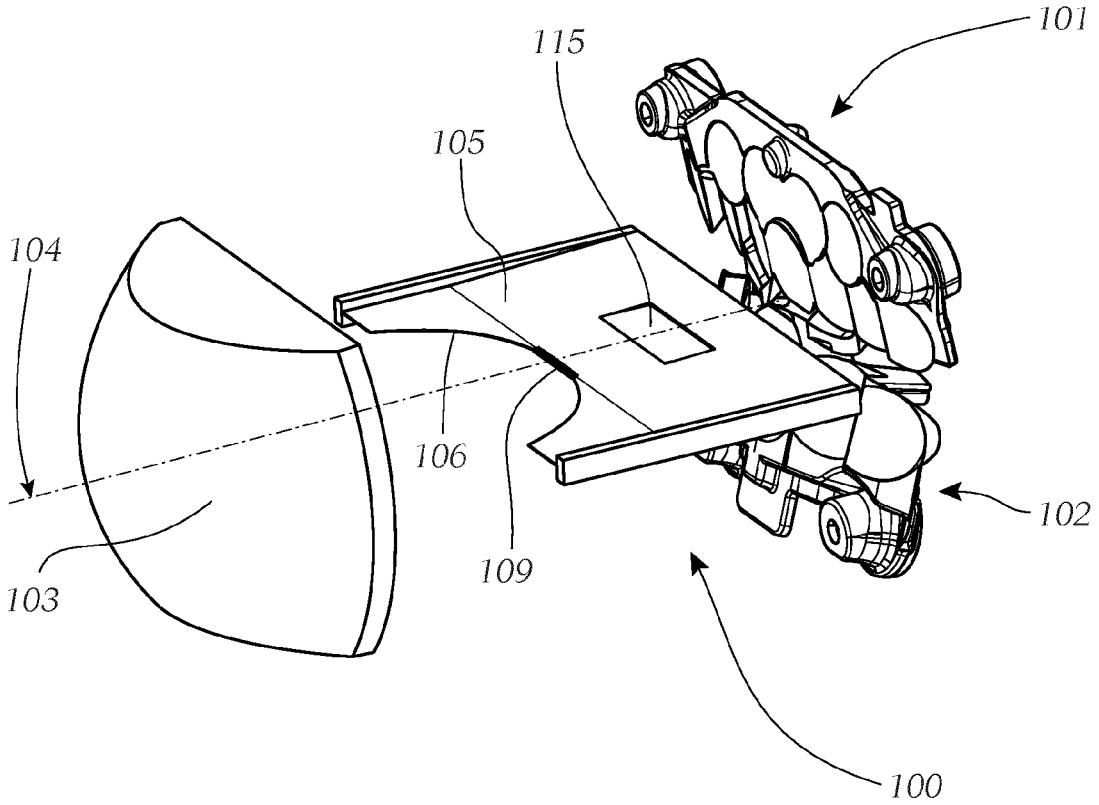

surface (116), the geometric structure (109, 409) has at least one prism body (110, 210, 310, 410, 510) with a triangular cross-sectional area, which is elongated and the longitudinal extent runs substantially transversely to the optical axis (104, 204, 404), the at least one prism body (110, 210, 310, 410, 510) has a first, a second and a third prism surface, the second prism surface (112, 212, 312, 512) encloses an internal angle $\alpha 1 \geq \theta$ with the first prism surface (111, 211, 311), and the third prism surface (113, 213, 313, 513) encloses an internal angle $\alpha 2 \geq \theta$ with the first prism surface (111, 211, 311), wherein $\theta$ is the critical angle of total internal reflection of the transparent material, the internal angles $\alpha 1$ and $\alpha 2$ are the same or different, and with the proviso that the internal angle $\alpha 1$ or the internal angle $\alpha 2$ is not 45°.

17 Claims, 7 Drawing Sheets

(51) Int. Cl.

| | |
|---|---|
| ***F21S 41/20*** | (2018.01) |
| ***F21S 41/663*** | (2018.01) |
| ***F21S 41/43*** | (2018.01) |
| ***F21W 102/18*** | (2018.01) |
| ***F21W 102/16*** | (2018.01) |

(52) U.S. Cl.
CPC ..... *F21S 41/663* (2018.01); *F21W 2102/16* (2018.01); *F21W 2102/18* (2018.01)

LIGHT UNIT FOR A MOTOR VEHICLE HEADLAMP

The invention relates to a lamp unit for a lighting device of a motor vehicle, particularly for a motor-vehicle headlamp, comprising: at least one dipped-beam module for generating a dipped-beam light distribution, for the most part below a horizontal cut-off line imaged substantially in front of the motor vehicle, at least one main-beam module for generating a main-beam light distribution, for the most part above the cut-off line, an imaging optical element connected downstream of the dipped-beam module and the main-beam module in the optical beam direction for generating a total light distribution of the light modules, having an optical axis and a focal surface orientated substantially normal to the optical axis, and a diaphragm, which has a diaphragm edge and extends essentially up to the focal surface of the imaging optical element for generating the horizontal cut-off line in a light image generated by the lamp unit.

Lighting devices and light modules for motor vehicles which are set up to generate various light distributions and cut-off lines by means of corresponding control and to project them onto the carriageway are sufficiently known. These different light distributions and cut-off lines are blocked out in a targeted manner according to a sufficiently known principle by means of a beam diaphragm, using which a part of the emitted light beams is blocked out. By means of the diaphragm, inter alia, a sharp cut-off line can be obtained in a light image generated by the dipped-beam function, so that a dazzlement of road users who are driving on ahead or oncoming is substantially avoided.

Lamp units according to the design mentioned at the beginning are sufficiently known. The dipped-beam module, which is arranged at the top in the installed state in the motor vehicle, and the main-beam module, which is installed at the bottom in the installed state in the motor vehicle, interact via the common diaphragm body and the common imaging optical element, so that the imaging optical element influences the intermediate light images both of the dipped-beam module and of the main-beam module and the diaphragm influences the beam paths of both modules. Generally common to lamp units of this type is the disadvantage that they do not allow any targeted mixing or overlapping of the light beams of the dipped-beam module attached at the top and the main-beam module attached at the bottom. Because beam diaphragms cannot be infinitely thinly constructed and this material thickness, which is inevitably present at the diaphragm edge of the diaphragm, is imaged by the downstream-connected imaging optical element in the light image generated, a dark gap, which is visible for the vehicle driver, is created in the region of the cut-off line during the overlaying of the two partial light distributions (i.e. dipped beam and main beam) to form a total light distribution (main beam function). This disruptive inhomogeneity in the light image projected onto the road makes it more difficult for the vehicle driver to recognize the environment, as a result of which the accident risk increases. In the prior art, for example in DE 602004002043 T2, FR 2962786 A1 or AT 514161 A1, to solve this known problem, it is suggested to arrange optical elements in the region of the focal plane of the projection lens for targeted mixing or overlapping of the light distribution generated above and below the diaphragm and for influencing the cut-off line. A different solution is known from WO 2015014706 A1, in which a diaphragm body made from transparent material is provided with a mirror layer, wherein although the overlap between dipped beam and main beam is improved due to the transparently held diaphragm edge, disruptive scattered light is generated in the region above the H-H line owing to the transmission of the light at the diaphragm edge.

A further disadvantage of known beam diaphragms consists in these possibly vaporizing or burning out due to the burning lens effect. The critical region here is located in the, in particular centrally located, edge region of the beam diaphragm, which is shaped along the focal curve of the imaging optical element (e.g. projection lens).

It is an object of the invention to provide a light module according to the type mentioned at the beginning, inter alia comprising a dipped-beam module, a main-beam module, a beam diaphragm set up for generating a horizontal light/dark boundary, and an imaging optical element, in which the above-described dark gap in the light image between main beam and dipped beam is closed, the generation of disruptive scattered light in the region above the cut-off line is avoided to the greatest extent and the above-mentioned problem with respect to the burning lens effect in the critical diaphragm edge region is solved.

This object is achieved with a lamp unit for a lighting device of a motor vehicle, particularly for a motor-vehicle headlamp of the type mentioned at the beginning is achieved in that the diaphragm has a substantially flat opaque diaphragm region and has a transparent diaphragm region with a geometric structure made from a transparent material at the diaphragm edge in the region of the focal surface, wherein the geometric structure comprises at least one prism body with a substantially triangular cross-sectional area, the at least one prism body is elongated and the longitudinal extent runs substantially transversely to the optical axis, the at least one prism body has a first, a second and a third prism surface, wherein the first prism surface is substantially flush with the flat opaque diaphragm region, the second prism surface faces the opaque diaphragm region and encloses an internal angle $\alpha 1 \geq \theta$ with the first prism surface, and the third prism surface faces away from the opaque diaphragm region and encloses an internal angle $\alpha 2 \geq \theta$ with the first prism surface, wherein $\theta$ is the critical angle of total internal reflection of the transparent material, the internal angles $\alpha 1$ and $\alpha 2$ are the same or different, and with the proviso that the internal angle $\alpha 1$ or the internal angle $\alpha 2$ is not 45°.

Figure 7:
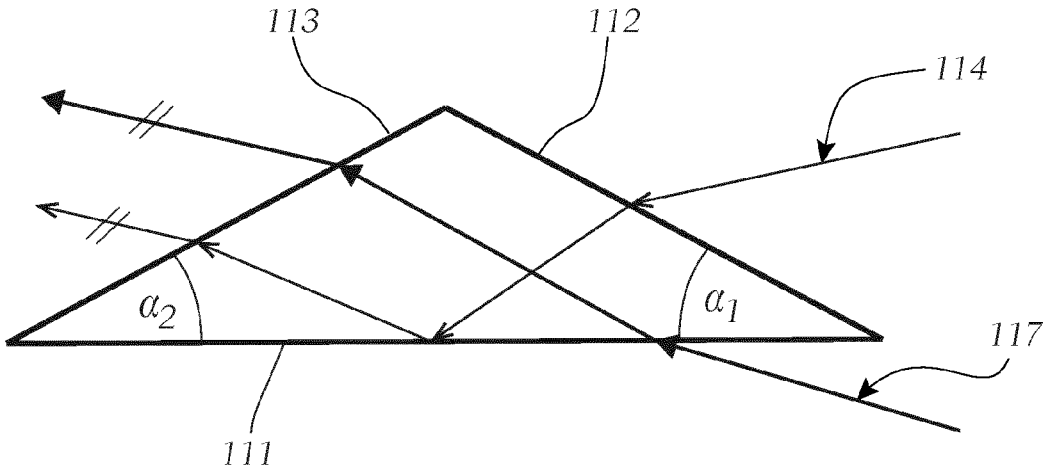

In the diaphragm according to the invention, the light beams generated by the dipped-beam module are totally internally reflected by the prism structure at the diaphragm edge into the region of the near field, so that the generation of disruptive scattered light in the region above the H-H line is prevented, whereas the light beams which are generated by the main-beam module pass through the prism structure transmissively and are diffracted at this prism structure in such a manner, that the dark gap between the dipped beam and the main beam in the light image is closed when the main beam function is switched on (to this end, see also FIG. 7, in which the beam paths are illustrated schematically, and the description for the same).

Furthermore, the problem with respect to the burning lens effect is solved, as thanks to the transparent diaphragm region, which comprises the geometric prisms structure, the light beams, e.g. of sunlight, are no longer absorbed, but rather penetrate the material and branch divergently. A further advantage lies in the fact that the light beams totally internally reflected at the prism structure, which are generated by the dipped-beam module, are refracted, so that a softer transition or a desired gradient is generated at the cut-off line. Thus, no further measures, e.g. a microstructure on the imaging optical element, have to be put in place, in order to generate a desired gradient for softening the cut-off line.

Thus, the invention solves a plurality of current light-technology problems of lamp units, which have a dipped-beam module, a main-beam module and a beam diaphragm for generating a horizontal cut-off line.

The diaphragm, which has a substantially flat appearance, may lie substantially horizontally in the optical axis in a manner known per se or be inclined slightly towards the optical axis. In certain variants, the diaphragm may also have a kink along a horizontal line, so that the diaphragm body does not have a continuous planar boundary surface. Furthermore, it is also possible to implement an increase in asymmetry in the light distribution, in that the at least one prism body and if appropriate the diaphragm body has two regions which are offset with respect to one another in terms of height, wherein the one region lies to the left and the other region lies to the right of the optical axis and wherein the two regions are connected to one another by an inclined transition region, through which the optical axis runs (see FIG. 10 and description of the same).

Figure 9:
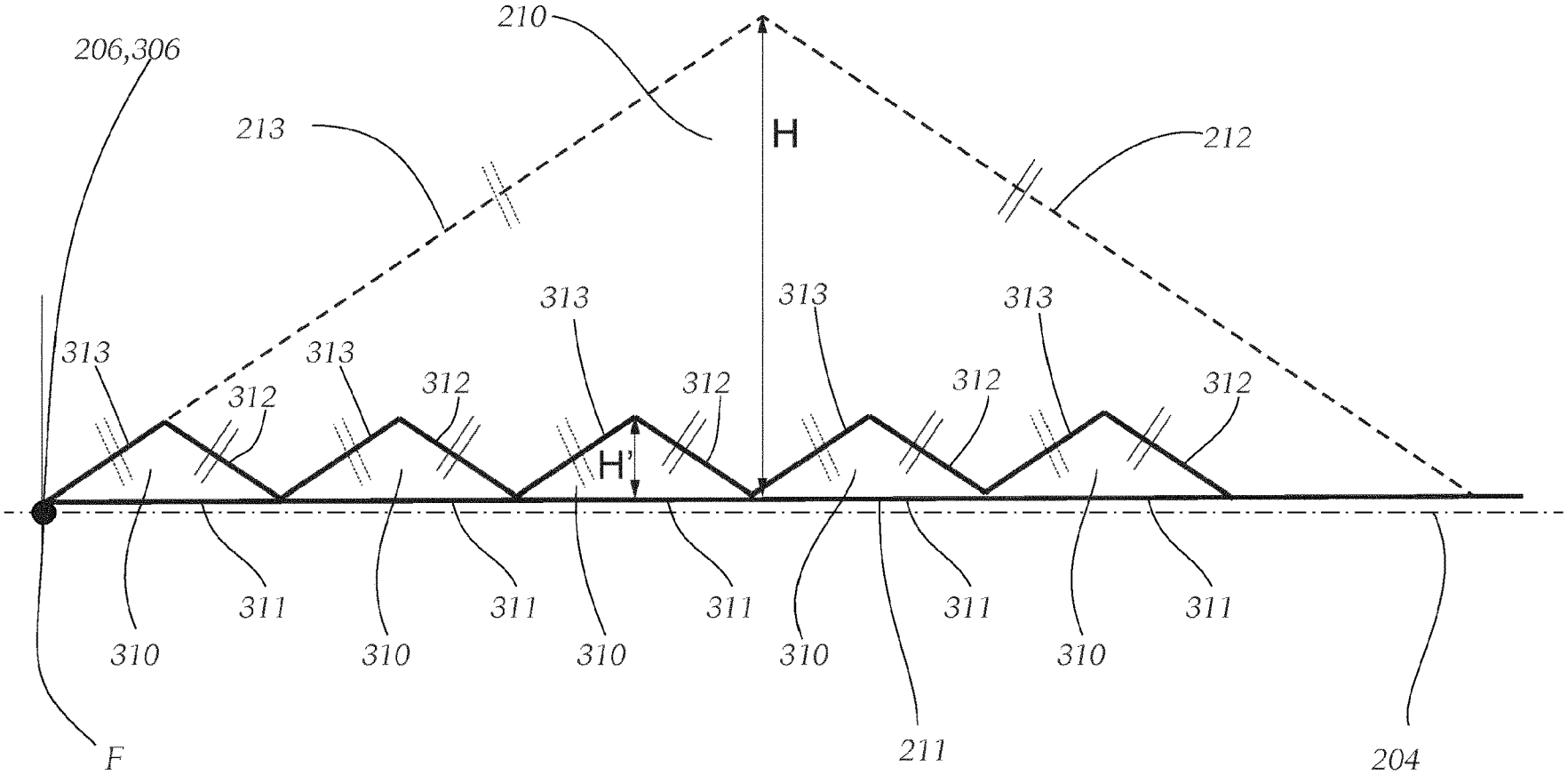

The geometric structure may comprise one single large prism or two or more smaller prisms, wherein the large or the two or more smaller prisms must fulfil the technical features defined above or in Claim 1 with regards to the arrangement and the internal angles (see also FIG. 9 and the description of the same). It was determined that different geometric structures than the prism structure defined herein, for example a wedge shape with an internal angle $\alpha 1$ or an internal angle $\alpha 2$ of 45°, do not bring the desired advantages and for example also entail total internal reflection for the main beam or an undesired transmission of the light beams of the dipped beam.

In the case of a plurality of triangular prisms arranged in a row, these may have the same height. Alternatively, the heights of the prisms arranged in a row may increase steadily, which entails the advantage that a smaller triangular prism triangular prism lying closer to the focal point shades proportionately fewer light beams of the main beam, which enter into the transparent geometric structure of the diaphragm through the first prism surfaces of the triangular prisms. For example, fewer light beams of the main beam are totally internally reflected at a second prism surface of a prism with a smaller height lying closer to the focal point, which enter via a first prism surface of a triangular prism with greater height. The increase of the heights of the triangular prisms advantageously follows a parabolic curve trace.

Imaging optical elements for headlamps are well-known per se to the person skilled in the art. The imaging optical element may be structured according to a manner known per se and for example comprise a projection lens or a multi-stage lens system; further, lens-reflector combinations are also possible.

In certain variants, the geometric structure comprises at least two prism bodies arranged one behind the other in the optical beam direction, the first prism surfaces of which adjoin one another longitudinally and are flush with one another.

Preferably, the geometric structure is formed from exactly two prism bodies arranged one behind the other in the optical beam direction, the first prism surfaces of which adjoin one another longitudinally and are flush with one another; owing to the required geometric dimensions with respect to the prism surface and the base thickness of the diaphragm, a geometric structure with exactly two prism bodies arranged in the optical beam direction has been established as particularly advantageous, because as a result, on the one hand, the above-mentioned technical objects to be achieved can be achieved optimally owing to the distance of the geometric structure from the focal surface or from the focal point of the imaging optical element, and this variant can furthermore be realized easily in terms of technology. Undesired colour effects and the formation of a blurred cut-off line, which may possibly occur for a higher number of prism bodies, e.g. in the case of more than three prisms, can be avoided in the case of this preferred variant, owing to the larger distance of the prism structures from the focal surface/focal point.

In certain variants, the at least one prism body has two regions transitioning into one another in the longitudinal direction, which regions are offset with respect to one another in terms of height, and are connected to one another by means of a, preferably oblique, transition region, through which the optical axis runs. As a result, it is possible to realize an increase in asymmetry in the light distribution (see FIG. 10 and description of the same).

In certain variants, the opaque diaphragm region may have a reflective surface at least to some extent.

In certain design variants, the diaphragm is manufactured in one piece from the transparent material and the opaque diaphragm region is vapour coated according to the known manner, e.g. vapour coated using a metal such as aluminium, or mirror coated.

In other variants, the opaque diaphragm region is manufactured from an opaque material (e.g. metal or opaque plastic) and the transparent diaphragm region comprising the geometric structure is an insert made from the transparent material (e.g. glass or transparent plastic), or the diaphragm is produced by means of a multi-component injection moulding method using transparent and opaque plastic materials, e.g. by means of a two-component injection moulding method using an opaque and a transparent plastic material.

Preferably, the transparent material is plastic or glass.

In certain variants, the second and/or third prism surface is of essentially planar construction.

In specific variants, the second and/or third prism surface is curved, preferably the third prism surface is curved inwardly. These variants have the advantage that the gradient of the cut-off line can therefore additionally be influenced positively, so that a soft transition of the cut-off line can be realized (see also FIG. 11 and FIG. 12 and the description for the same). In certain sub-variants, the cross-sectional area of the at least one prism body is uniform in the longitudinal extent. In other sub-variants, it may be provided that the cross-sectional area of the at least one prism body increases in the longitudinal extent; in such a manner, the gradient of the cut-off line widens towards the edge regions of the light distribution, so that the illumination of the roadsides can be configured particularly pleasantly for the motor-vehicle driver.

In advantageous variants, the at least one dipped-beam module and the at least one main-beam module comprise at least one light source in each case, wherein a collimator is assigned to each light source in the optical beam direction and the collimator is set up to reduce the size of the beam angle of the light beams generated by the light source and to configure the radiation characteristic as a result. In these variants, the lamp unit may for example be a collimator module, which comprises the at least one dipped-beam module and the at least one main-beam module and wherein a plurality of light sources is assigned to the dipped-beam and the main-beam module and a collimator is connected downstream of each light source in the optical beam direction. The diaphragm is connected downstream of the collimator module in the optical beam direction. A projection lens or a multi-stage lens system can be provided as an imaging optical element. The collimator may for example be constructed as a collimator lens (TIR—Total Internal Reflection). Such TIR collimator lenses are sufficiently known to a person skilled in the art (e.g. Bern TIR lens from Auer Lighting GmbH, DE); these are optically transparent bodies, which are manufactured from a transparent material, the refractive index of which is greater than the refractive index of air, e.g. from glass or plastic; in this case, essentially the totality of the light refracted at the light outcoupling surface of the TIR collimator lens propagates further through the air, preferably in a predetermined direction with a reduction in the size of the divergence compared to the light propagation upstream of the light in-coupling surface. It is also conceivable that the collimator is constructed as a reflector, i.e. as a (primarily visible) light reflective surface, which deflects light beams propagating through air in a preferably predetermined direction. The light-distribution-shaping components of the dipped-beam module and/or main-beam module may however also be realized in the form of poly-ellipsoidal reflector arrangements according to the projection headlamp type, as is sufficiently known to the person skilled in the art.

In advantageous variants of the invention, the diaphragm has at least one light window, wherein at least one light path runs from the dipped-beam and/or main-beam modules through the at least one light window and through the imaging optical element to the outside. By means of this development, it is possible additionally to mix the light beams, which are generated by the dipped-beam module and the main-beam module, in a targeted manner and additionally to minimize inhomogeneities in the light image of a main beam function. Furthermore, a targeted radiation of light beams is possible in regions of the light image, which are usually of particular importance for illuminating road signs (what is known as a "sign light"). In certain sub-variants, it may be provided that the at least one light path runs through the at least one light window exclusively from the dipped-beam module through the at least one light window and through the imaging optical element to the outside. In certain sub-variants, the at least one light window may be arranged in the opaque diaphragm region of the diaphragm and delimited by the same, wherein the light window is constructed as a recess in the opaque diaphragm region of the diaphragm or consists of a transparent material.

A further subject of the invention is a motor-vehicle headlamp, which comprises at least one lamp unit according to the invention. The motor-vehicle headlamp is a front headlamp. The motor-vehicle headlamp according to the invention is expediently built in accordance with headlamp build principles which are known per se and comprises a housing with a light emission aperture, which is covered with a diffusing plate or a cover plate. Modern motor-vehicle headlamps often have a plurality of light modules, which can take on individual light functions in their own right or in interaction. These light modules are often arranged in direct proximity to one another in the headlamp housing. Therefore, in addition to a lamp unit according to the invention, which has a dipped-beam module and a main-beam module, the motor-vehicle headlamp according to the invention can also comprise further light modules, e.g. a daytime running light unit, an indicator unit, etc. Correspondingly, in addition to dipped-beam light distribution or main-beam light distribution, further light distributions can be generated by the further light modules, such as the light distribution of a daytime running light, an indicator, etc.

A further subject of the invention is a motor vehicle comprising at least one lamp unit according to the invention and/or a motor-vehicle headlamp according to the invention. The term "motor vehicle" (KFZ) as used herein relates to single- or multi-track motorized land-based vehicles, such as motorcycles, cars, lorries and the like.

Figure 2:
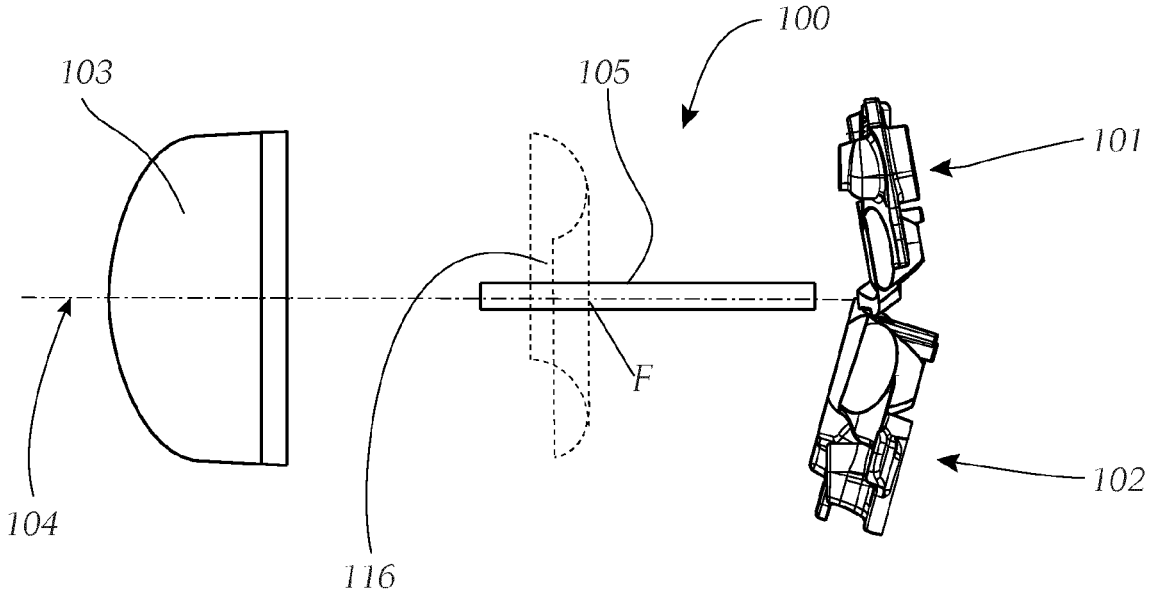
Figure 3:
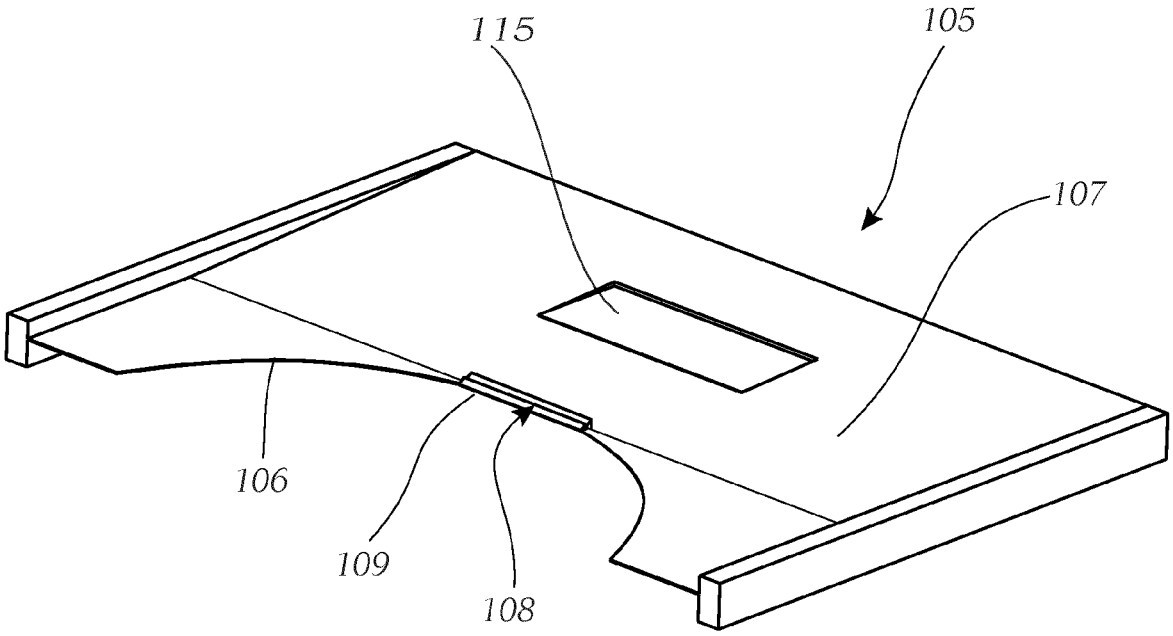
Figure 4:
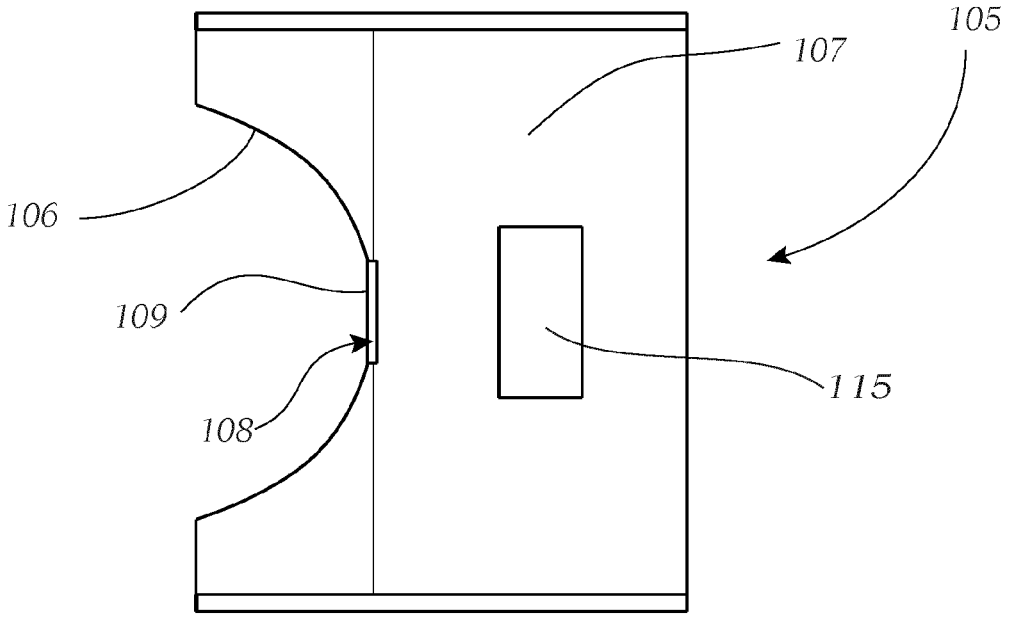
Figure 5:
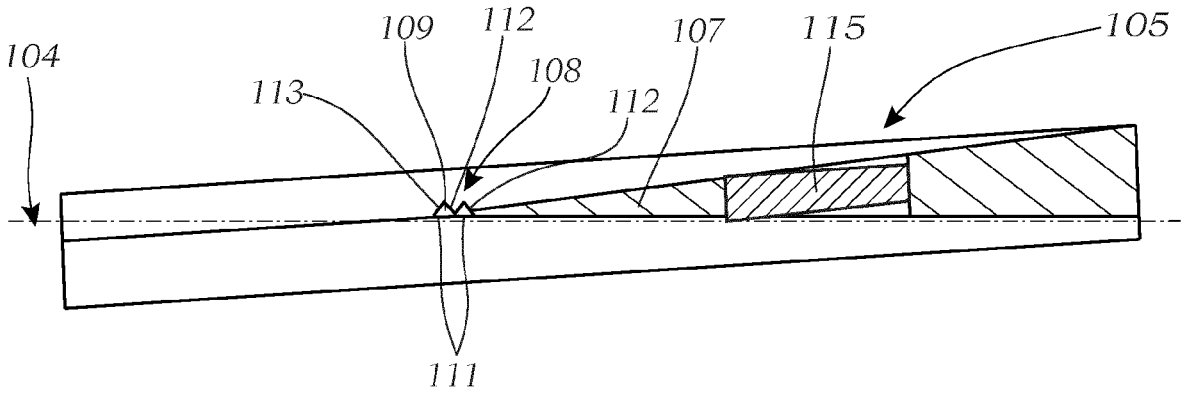
Figure 6:
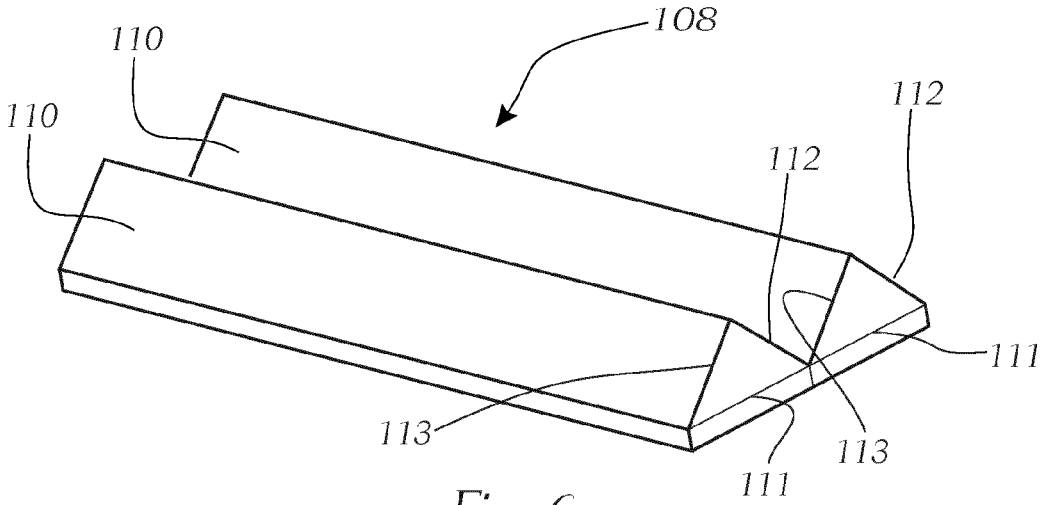
Figure 8:
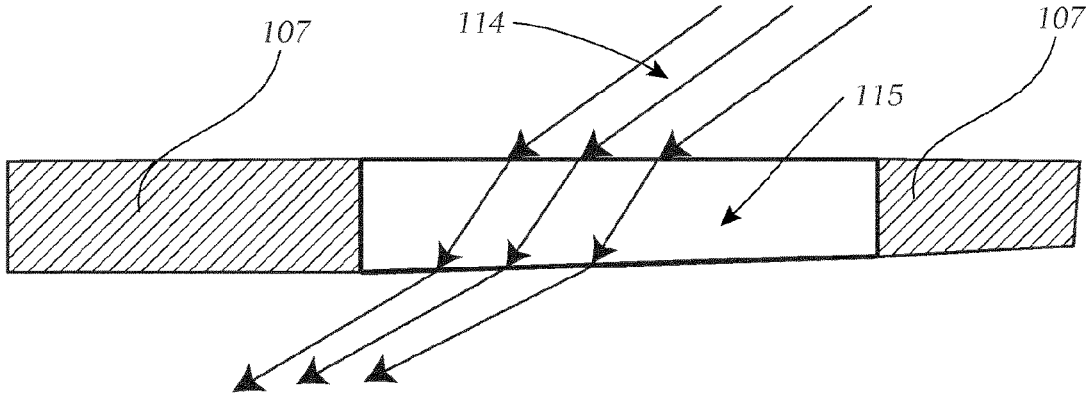
Figure 8A:
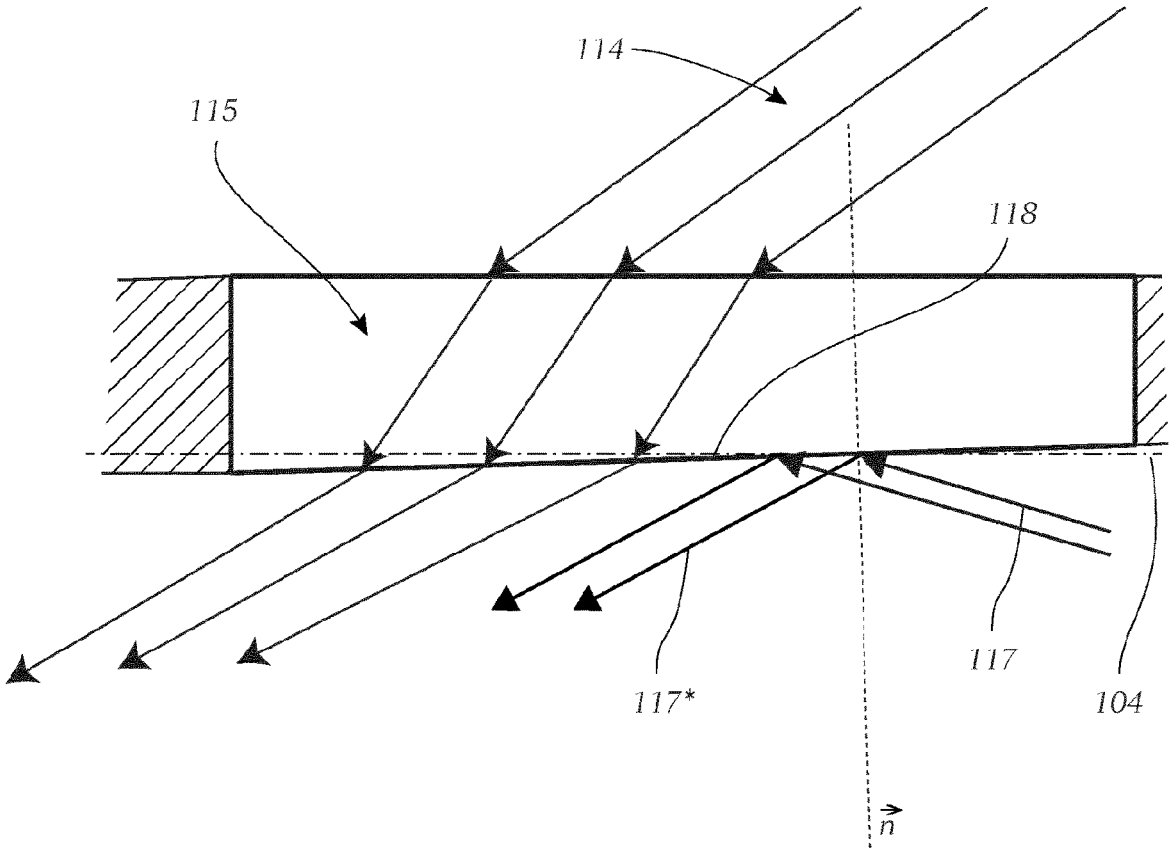
Figure 10:
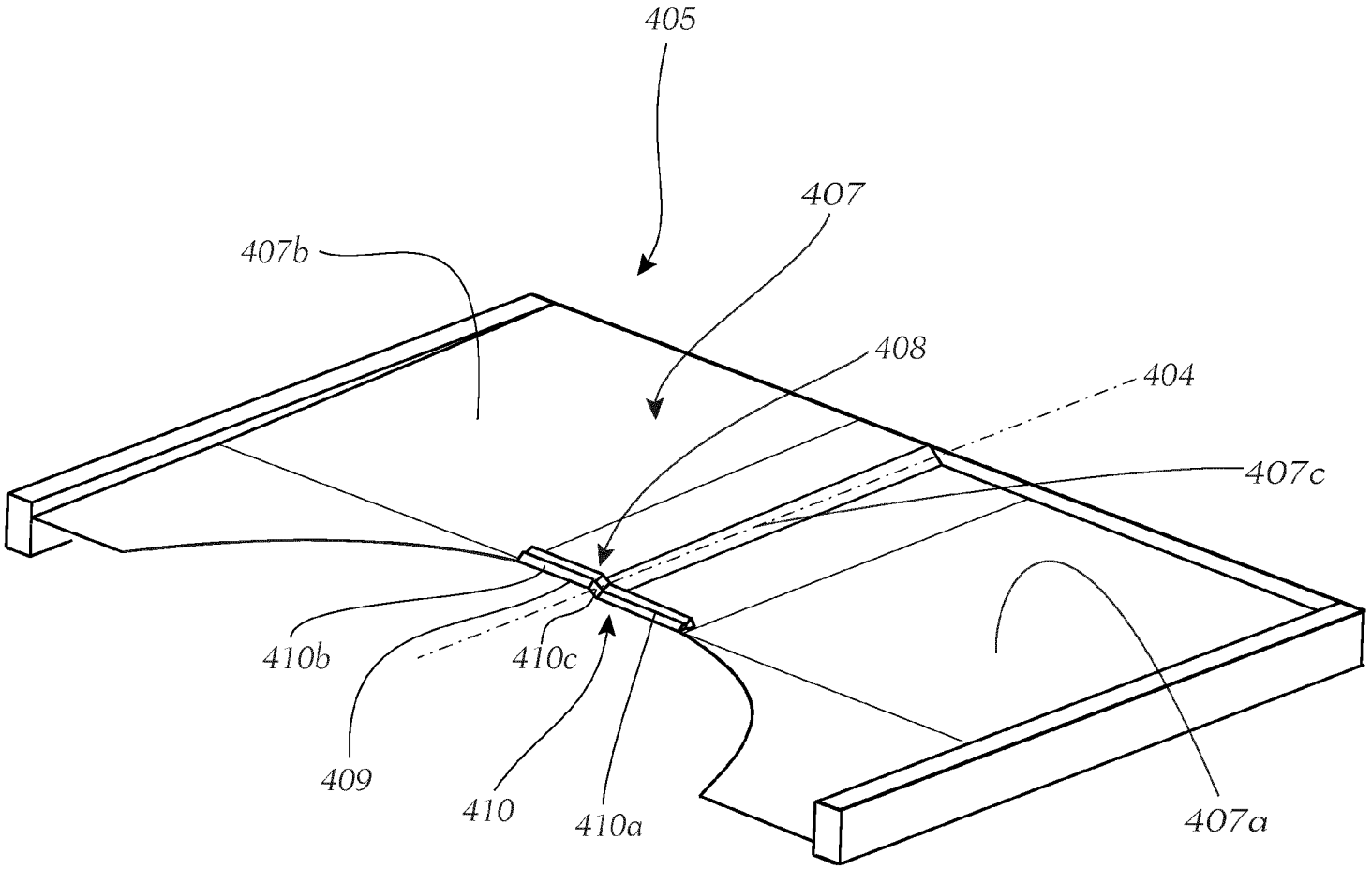
Figure 11:
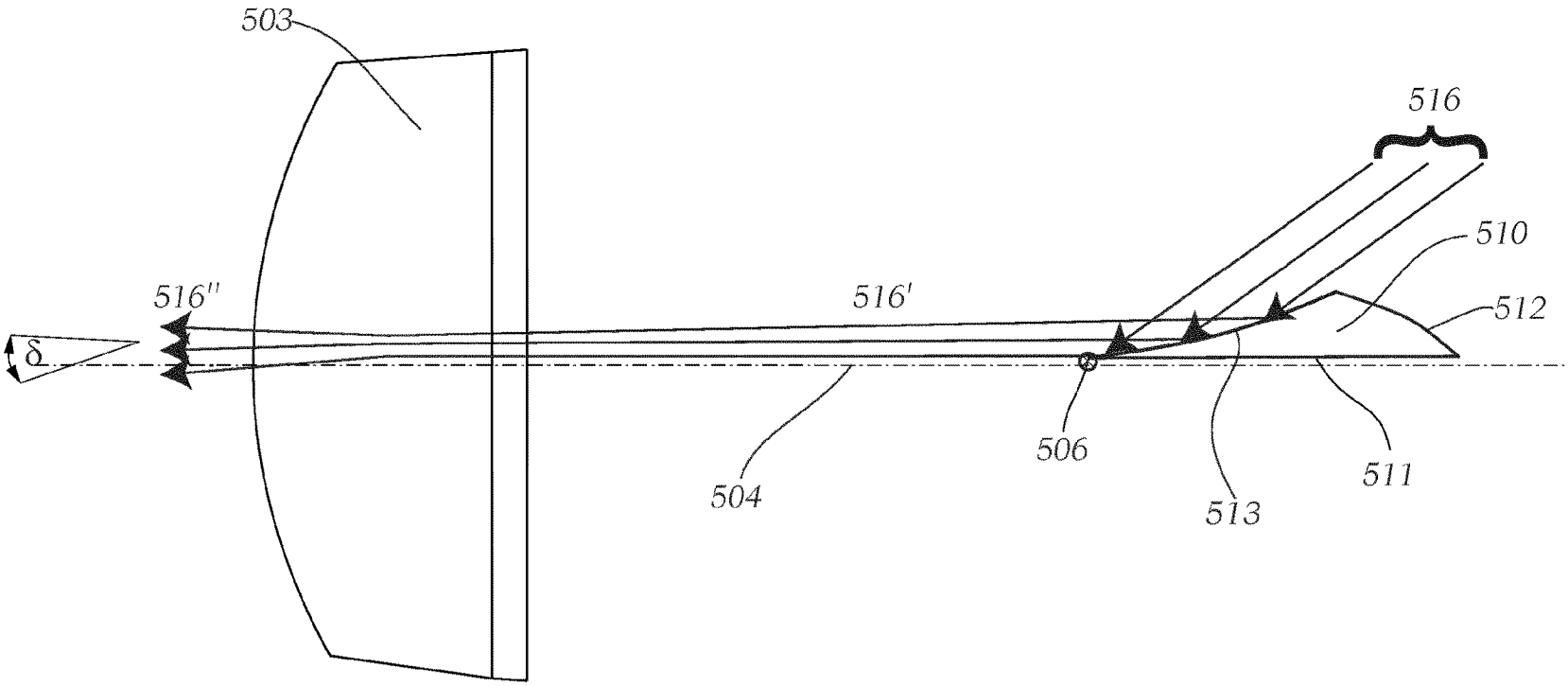
Figure 12:
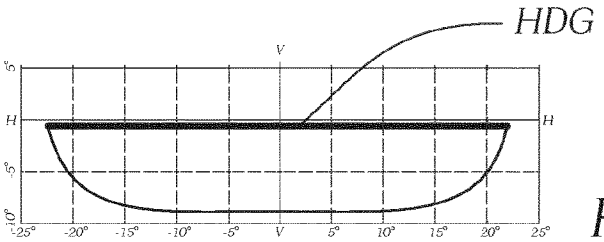

The invention including further advantages is described in more detail in the following on the basis of non-limiting examples and attached drawings, wherein in the drawings:

FIG. 1 shows a schematic illustration of a lamp unit according to the invention in a perspective view, FIG. 2 shows the lamp unit from FIG. 1 in a side view, FIG. 3 shows the diaphragm of the lamp unit illustrated in FIGS. 1 and 2 in a perspective view, FIG. 4 shows a plan view onto the diaphragm of the lamp unit illustrated in FIGS. 1 and 2, FIG. 5 shows a section through the diaphragm of the lamp unit illustrated in FIGS. 1 and 2 along the optical axis, FIG. 6 shows the geometric prism structure of the diaphragm of the lamp unit illustrated in FIGS. 1 and 2, FIG. 7 illustrates the beam path of the light beams, which are emitted by the dipped-beam module or by the main-beam module, through a triangular prism body of a diaphragm used according to the invention, FIG. 8 shows a detail view of a section through the diaphragm in FIG. 1 and FIG. 2 and illustrates the beam path of the light beams, which are emitted by the dipped-beam module, through a light window arranged in the diaphragm used according to the invention ("sign light"), FIG. 8*a* shows an enlarged view of FIG. 8, wherein in FIG. 8*a*, the beam path of the light beams which are emitted by the main-beam module is additionally illustrated, FIG. 9 illustrates the arrangement of a large triangular prism or a plurality of small triangular prisms of a diaphragm used according to the invention with respect to the focal point of the imaging optical element, FIG. 10 shows a modified variant of a diaphragm for a lamp unit according to the invention, FIG. 11 illustrates a gradient shape for softening the cut-off line in a dipped-beam light distribution with the aid of a diaphragm used according to the invention, which has a prism body with curved prism surfaces, and FIG. 12 shows an exemplary light distribution with cut-off line in a two-dimensional angular space on the basis of the lines H-H and V-V for a gradient shape according to FIG. 11.

It is understood that the embodiments described here are merely used for illustration and are not to be considered as limiting for the invention; but rather all configurations, which the person skilled in the art may find on the basis of the description, fall within the protective scope of the invention, wherein the protective scope is determined by the claims.

In the figures, for the purposes of simpler explanation and illustration, the same reference numbers are used for the same or comparable elements. The reference numbers used in the claims should further merely facilitate the readability of the claims and the understanding of the invention and in no way have a character impairing the protective scope of the invention.

FIG. 1 shows a schematic illustration of a design variant of a lamp unit 100 according to the invention in a perspective view. FIG. 2 shows the lamp unit 100 from FIG. 1 in a side view. The lamp unit 100 is provided for installation in a lighting device of a motor vehicle, particularly for a motor-vehicle headlamp (front headlamp). The lamp unit 100 comprises a dipped-beam module 101, a main-beam module 102 and an imaging optical element, in the form of a projection lens 103 with an optical axis 104 and a focal surface 116 orientated substantially normal to the optical axis 104, also termed a Petzval surface, which imaging optical element is connected downstream of the dipped-beam module 101 and the main-beam module 102 in the optical beam direction for generating a total light distribution of the light module. The dipped-beam module 101 is set up for generating a dipped-beam light distribution, for the most part below a horizontal cut-off line imaged substantially in front of the motor vehicle. The main-beam module 102 is set up for generating a main-beam light distribution, for the most part above the cut-off line. Furthermore, the lamp unit 100 comprises an essentially horizontally lying diaphragm 105, which has a diaphragm edge 106 and extends essentially up to the focal surface 116 of the downstream-connected projection lens 103 for generating the horizontal cut-off line in a light image generated by the lamp unit 100. In this case, the diaphragm edge 106 reaches as far as the focal surface 116 or up to the focal point F of the projection lens 103.

In the example shown, the dipped-beam module 101 and the main-beam module 102 together form a collimator module, which is structured according to generally known principles and does not have to be explained in more detail at this point (see also description of collimators, e.g. TIR collimator lenses, above). The dipped-beam module 101 and the main-beam module 102 in each case comprise a plurality of light sources, which are not illustrated in more detail, e.g. realized as LEDs, wherein a collimator, which is likewise not illustrated in any more detail, is assigned to each light source in the optical beam direction. Each collimator is set up to reduce the divergence of the light beams generated by the light source. The collimator module also comprises further optical components, such as e.g. lenses or reflectors. The dipped-beam module 101 and the main-beam module 102 can however also be structured according to other design principles and are not limited to the collimator structure illustrated schematically in FIG. 1 and FIG. 2. Alternatively, the dipped-beam module and/or the main-beam module may have reflectors according to the classic PES (poly ellipsoid system) headlamp type, which is sufficiently known in the specialist field.

The features according to the invention of the lamp unit 100 are found in the diaphragm 105, which is explained in more detail in the following figures.

FIG. 3 shows the diaphragm 105 of the lamp unit 100 illustrated in FIGS. 1 and 2 in a perspective view, FIG. 4 shows a plan view onto the diaphragm 105 and FIG. 5 shows a section through diaphragm 105. FIG. 6 shows the geometric prism structure of the diaphragm of the lamp unit illustrated in FIGS. 1 and 2 in detail. The diaphragm 105 has a substantially flat opaque diaphragm region 107 and has a transparent diaphragm region 108 with a geometric structure 109 made from a transparent material at the diaphragm edge 106 in the region of the focal surface 116. It is understood implicitly that the opaque diaphragm region 107 may have a reflective surface at least to some extent.

In the example shown, the opaque diaphragm region 107 is manufactured from metal and the transparent diaphragm region 108 comprising the geometric structure 109 is an insert made from the transparent material. It is however also possible to manufacture the diaphragm 105 in one piece from the transparent material and the opaque diaphragm region 107 is vapour coated according to the known manner, e.g. vapour coated using a metal such as aluminium, wherein the transparent diaphragm region 108 is left out and is therefore not vapour coated. In the example shown, the transparent material is plastic. Instead of plastic, glass may also be chosen as opaque material.

The geometric structure 109 of the exemplary diaphragm 105 comprises two prism bodies 110 with a substantially triangular cross-sectional area in each case. Each prism body 110 is elongated and the longitudinal extent runs substantially transversely to the optical axis 104. Each prism body has a first, a second and a third prism surface, wherein the first prism surface 111 is substantially flush with the flat opaque diaphragm region 107, the second prism surface 112 faces the opaque diaphragm region 107 and encloses an internal angle $\alpha 1 \geq \theta$ with the first prism surface 111, and the third prism surface 113 faces away from the opaque diaphragm region 107 and encloses an internal angle $\alpha 2 \geq \theta$ with the first prism surface 111, wherein $\theta$ is the critical angle of total internal reflection of the transparent material, the internal angles $\alpha 1$ and $\alpha 2$ are the same or different, and with the proviso that the internal angle $\alpha 1$ or the internal angle $\alpha 2$ is not 45°.

FIG. 7 illustrates the beam path of the light beams, which are emitted by the dipped-beam module or by the main-beam module, through one of the two prism bodies 110 of the diaphragm 105 used according to the invention. The light beams 114 generated by the dipped-beam module 101 pass through the second prism surface 112 into the prism body 110 and are totally internally reflected at the first prism surface 111 and exit through the third prism surface 113, so that the generation of disruptive scattered light in the region above the H-H line is prevented. The light beams 117 which are generated by the main-beam module 102 enter through the first prism surface 111, are transmitted by the prism body and diffracted slightly upon exit through the third prism surface 113, so that the gap between the dipped beam and the main beam in the light image of the main beam function (i.e. dipped beam and main beam are switched on) is closed.

A development of the invention is likewise represented in the diaphragm 105. The diaphragm 105 has a light window 115, which is arranged in the opaque diaphragm region 107 of the diaphragm 105 and is delimited by the same. The light window 115 is created in that a window-shaped recess in the opaque diaphragm region 107 is closed using an insert plate made from transparent plastic. The light path from the dipped-beam and/or main-beam modules can run through the light window 115 and through the projection lens to the outside. By means of this development, it is possible additionally to mix the light beams, which are generated by the dipped-beam module and the main-beam module, in a targeted manner and additionally to minimize inhomogeneities in the light image of a main beam function. Furthermore, a targeted radiation of light beams is possible in regions of the light image, which are usually of particular importance for illuminating road signs (what is known as a "sign light"). For example, it may be provided that the light path runs through the light window 115 exclusively from the dipped-beam module 101 through the light window 115 and through the imaging optical element 101 to the outside. This is shown in FIG. 8, which shows a detail view of a section through the diaphragm in FIG. 1 and FIG. 2 and illustrates the beam path of the light beams 114, which are emitted by the dipped-beam module 101, through the light window 115 arranged in the diaphragm 105 ("sign light"). FIG. 8*a* shows an enlarged view of FIG. 8, wherein the beam path of the light beams 117, which are emitted by the main-beam module 102, is additionally illustrated. The light beams 117 from the main-beam module are totally internally reflected at the lower boundary surface 118 of the light window 115, which boundary surface is inclined to the optical axis 104 (in FIG. 8*a*, the totally internally reflected light beams are labelled with 117*). Thus, the light beams 117 have an angle of incidence to the normal n to the boundary surface 118 greater than the angle of total internal reflection. As a result, it is prevented that light from the main-beam module contributes to the near field in the dipped-beam light distribution and thus allows compliance with legal requirements {USA FMVSS-108 TableXVIII UB2: measuring point [4D,V] with a specification for the luminous intensity <12000 cd Maximum Photometric Intensity}. The required inclination may also be achieved by a prismatic configuration of this lower boundary surface 118.

FIG. 9 illustrates two exemplary alternative variants for triangular prisms of a diaphragm used according to the invention, namely on the one hand the arrangement of a single large triangular prism 210 with a height H and, alternatively to that, on the other hand the arrangement of a plurality of (in total five) small triangular prisms 310. The triangular prisms 210 or 310 are in each case arranged in the transparent region on the diaphragm edge of a diaphragm used according to the invention and positioned in the lamp unit according to the invention with respect to the focal surface or the focal point F of the imaging optical element (e.g. a projection lens 103 from FIG. 1 and FIG. 2). With respect to the description of the prism bodies 110 above, the triangular prisms 210 or 310 in each case comprise a first prism surface 211 or 311, a second prism surface 212 or 312, and a third prism surface 213 or 313. As can be seen well in FIG. 9, the respectively first prism surface 211 or 311 of the triangular prisms 210 or 310 runs substantially parallel to the optical axis 204. As can be seen well from FIG. 9, the second prism surfaces 312 of the five small triangular prisms 310 lie parallel to the second prism surface 212 of the large triangular prism 210; the third prism surfaces 313 of the small triangular prisms 310 lie parallel to the third prism surface 213 of the large triangular prism 210. The diaphragm edge 206 or 306 is defined by the prism edge formed from prism surfaces 211 and 213 or 311 and 313 (in the case of the small triangular prisms 310 by the outermost prism 310 located closest to the imaging optical element). In FIG. 9, the diaphragm edge 206 or 306 extends exactly up to the focal point F of the imaging optical element/projection lens.

The small triangular prisms 310 shown in FIG. 9 all have the same height H'. However, it will be evident to a person skilled in the art in the field that the heights of the prisms arranged in arranged in a row may increase steadily. This has the advantage that a smaller triangular prism triangular prism lying closer to the focal point shades proportionately fewer light beams of the main beam, which enter into the transparent geometric structure of the diaphragm through the first prism surfaces of the triangular prisms. For example, fewer light beams of the main beam are totally internally reflected at a second prism surface of a prism with a smaller height lying closer to the focal point, which enter via a first prism surface of a triangular prism with greater height. The increase of the heights of the triangular prisms advantageously follows a parabolic curve trace.

FIG. 10 shows a modified variant of a diaphragm 405 for a lamp unit according to the invention. The diaphragm 405 is substantially like the above-described diaphragm 105. The diaphragm 405 has a substantially flat opaque diaphragm region 407 and has a transparent diaphragm region 408 with a geometric structure 409 comprising two prism bodies 410 made from a transparent material at the diaphragm edge 406 in the region of the focal surface. The prism bodies 410 have two regions 410*a* and 410*b* transitioning into one another in the longitudinal direction, which regions are offset with respect to one another in terms of height, and are connected to one another by means of an oblique transition region 410*c*, through which the optical axis 404 runs. Likewise, the opaque region 407 also comprises two regions 407*a* and 407*b* transitioning into one another and offset with respect to one another in terms of height, which are connected to one another by means of an oblique transition region 407*c*, through which the optical axis 404 runs. As a result, it is possible to realize an increase in asymmetry in the light distribution. Thus, as in the case of the above-described prism bodies 110, 210 and 310, the prism bodies 410 comprise a first, a second and a third prism surface (not provided with reference numbers in FIG. 10 for reasons of space), the second prism surface faces the opaque diaphragm region 407 and encloses an internal angle $\alpha 1 \geq \theta$ with the first prism surface, and the third prism surface faces away from the opaque diaphragm region 407 and encloses an internal angle $\alpha 2 \geq \theta$ with the first prism surface, wherein $\theta$ is the critical angle of total internal reflection of the transparent material, the internal angles $\alpha 1$ and $\alpha 2$ are the same or different, and with the proviso that the internal angle $\alpha 1$ or the internal angle $\alpha 2$ is not 45°. Thus, like the diaphragm 105, the diaphragm 405 can of course also be provided with a light window 115 for creating a "sign light" function.

FIG. 11 illustrates a gradient shape for softening the cut-off line in a dipped-beam light distribution with the aid of a diaphragm used according to the invention, which has a prism body with curved prism surfaces. FIG. 12 shows an exemplary light distribution with cut-off line in a two-dimensional angular space on the basis of the lines H-H and V-V for a gradient shape according to FIG. 11. An advantage lies in the fact that the light beams totally internally reflected at the prism structure, which are radiated by the dipped-beam module, are refracted in slightly different directions, so that a softer transition or a legally compliant gradient value of the cut-off line is generated, wherein the cut-off line is primarily determined by the diaphragm edge 506. A vehicle driver then perceives the light distribution without an irritating boundary line between illuminated and dark road surface. Thus, no further measures, e.g. a microstructure on the imaging optical element, have to be put in place, in order to effect a desired softening of the cut-off line. An advantageous development of the invention is illustrated in FIG. 11. In this development, a third prism surface 513 of a prism body 510 is curved inwards, wherein the cross-sectional area is uniform in the longitudinal extent. The prism body 510 is, as described above, a component of a diaphragm used according to the invention, which is not illustrated in more detail here, however. The use of a curved third prism surface 513 (and/or a curved second prism surface 512) has the advantage, that the gradient of the cut-off line is therefore set up in a particularly targeted manner and can be positively influenced, so that the cut-off line is split and imaged in a wider manner. For an observer or the vehicle driver, a particularly soft transition of the cut-off line therefore results in the light image. The light path of light beams 516 emitted by the dipped-beam module from the curved third prism surface 513 up to the passage through a projection lens 503 is illustrated in FIG. 11 on the basis of arrows. An exemplary parallel bundle of beams 516 undergoes a divergent total internal reflection bundle of beams 516' owing to different surface normals on the curved third prism surface 513. The divergence $\delta$ is enlarged further by the projection lens 503 owing to the different refraction of the light distribution bundle of beams 516". Similar is also true for light beams which enter into the prism body 510 via a generally curved second prism surface 512 and after total internal reflection at the generally planar first prism surface 511, leave the prism body 510 via the curved third prism surface 513. Light is refracted at the two prism surfaces 512 and 513 according to Snell's law of refraction. It can be seen from FIG. 12 that the cut-off line HDG, which runs somewhat below and parallel to the H-H line is widened further, as a result of which the gradient decreases.

The invention may be modified in any desired manner known to the person skilled in the art and is not limited to the embodiments shown. Also, individual aspects of the invention may be picked up and substantially combined with one another. What are important are the ideas upon which the invention is based, which may be realized by a person skilled in the art, upon considering this teaching, in myriad ways and be maintained as such in spite of that.

The invention claimed is:

1. A lamp unit (100) for a lighting device of a motor vehicle, particularly for a motor-vehicle headlamp, comprising:

at least one dipped-beam module (101) for generating a dipped-beam light distribution, a majority formed below a horizontal cut-off line imaged substantially in front of the motor vehicle, at least one main-beam module (102) for generating a main-beam light distribution, a majority formed above the cut-off line, an imaging optical element (103, 503) connected downstream of the dipped-beam module (101) and the main-beam module (102) in the optical beam direction for generating a total light distribution of the light modules, having an optical axis (104, 204, 404, 504) and a focal surface (116) orientated substantially normal to the optical axis (104, 204, 404, 504), and a diaphragm (105, 405), which has a diaphragm edge (106, 206, 306, 506) and extends substantially up to the focal surface (116) of the imaging optical element (103, 503) for generating the horizontal cut-off line in a light image generated by the lamp unit (100), wherein the diaphragm (105, 405) has a substantially flat opaque diaphragm region (107, 407) and has a transparent diaphragm region (108, 408) with a geometric structure (109, 409) made from a transparent material at the diaphragm edge (106, 206, 306, 506) in the region of the focal surface (116), wherein the geometric structure (109, 409) comprises at least one prism body (110, 210, 310, 410, 510) with a substantially triangular cross-sectional area, the at least one prism body (110, 210, 310, 410, 510) is elongated and the longitudinal extent runs substantially transversely to the optical axis (104, 204, 404, 504), the at least one prism body (110, 210, 310, 410, 510) has a first, a second and a third prism surface, wherein the first prism surface (111, 211, 311, 511) is substantially flush with the flat opaque diaphragm region (107, 407), the second prism surface (112, 212, 312, 512) faces the opaque diaphragm region (107, 407) and encloses an internal angle $\alpha 1 \geq \theta$ with the first prism surface (111, 211, 311), and the third prism surface (113, 213, 313, 513) faces away from the opaque diaphragm region (107, 407) and encloses an internal angle $\alpha 2 \geq \theta$ with the first prism surface (111, 211, 311), wherein $\theta$ is the critical angle of total internal reflection of the transparent material, the internal angles $\alpha 1$ and $\alpha 2$ are the same or different, and wherein the internal angle $\alpha 1$ or the internal angle $\alpha 2$ is not 45°.

2. The lamp unit according to claim 1, wherein the geometric structure (109, 409) comprises at least two prism bodies (110, 310, 410) arranged one behind the other in the optical beam direction, the first prism surfaces (111, 311) of which adjoin one another longitudinally and are flush with one another.

3. The lamp unit according to claim 2, wherein the geometric structure (109, 409) comprises at least two prism bodies (110, 410) arranged one behind the other in the optical beam direction, the first prism surfaces (111) of which adjoin one another longitudinally and are flush with one another.

4. The lamp unit according to claim 1, wherein the at least one prism body (410) has two regions (410*a*, 410*b*) transitioning into one another in the longitudinal direction, which regions are offset with respect to one another in terms of height, and are connected to one another by means of a transition region (410*c*) through which the optical axis (404) runs.

5. The lamp unit according to claim 1, wherein the diaphragm is manufactured in one piece from the transparent material and the opaque diaphragm region is metal vapour coated or mirror coated.

6. The lamp unit according to claim 1, wherein the opaque diaphragm region is manufactured from an opaque material and the transparent diaphragm region comprising the geometric structure is an insert made from the transparent material, or the diaphragm is produced by means of a multi-component injection moulding method using transparent and opaque plastic materials.

7. The lamp unit according to claim 1, wherein the transparent material is plastic or glass.

8. The lamp unit according to claim 1, wherein the second and/or third prism surface (112, 113, 212, 213, 312, 313) is substantially planar.

9. The lamp unit according to claim 1, wherein the second and/or third prism surface (512, 513) is curved.

10. The lamp unit according to claim 1, wherein the at least one dipped-beam module (101) and the at least one main-beam module (102) comprise at least one light source in each case, wherein a collimator is assigned to each light source in the optical beam direction and the collimator is configured to reduce the size of the beam angle of the light beams generated by the light source.

11. The lamp unit according to claim 1, wherein the diaphragm (101) has at least one light window (115), wherein at least one light path runs from the dipped-beam and/or main-beam modules (101, 102) through the at least one light window (115) and through the imaging optical element (103) to the outside.

12. The lamp unit according to claim 11, wherein the at least one light path runs through the at least one light window (115) exclusively from the dipped-beam module (101) through the at least one light window (115) and through the imaging optical element (103) to the outside.

13. The lamp unit according to claim 11, wherein the at least one light window (115) is configured to be arranged in the opaque diaphragm region (107) of the diaphragm (105) and delimited by the same, wherein the light window (115) is constructed as a recess in the opaque diaphragm region of the diaphragm or consists of a transparent material.

14. A motor-vehicle headlamp having at least one lamp unit (100) according to claim 1.

15. A motor-vehicle comprising at least one lamp unit (100) according to claim 1.

16. The lamp unit according to claim 4, wherein the transition region is oblique.

17. The lamp unit according to claim 9, wherein the third prism surface (513) is curved inwardly.

* * * * *